US008066452B2

(12) United States Patent
Melegari

(10) Patent No.: US 8,066,452 B2
(45) **Date of Patent: *Nov. 29, 2011**

(54) EQUIPMENT AND METHOD FOR CONSTRUCTING MICROPILES IN SOIL, IN PARTICULAR FOR THE ANCHORAGE OF ACTIVE ANCHORS

(76) Inventor: Cesare Melegari, Noceto (IT)

( * ) Notice: Subject to any disclaimer, the term of this patent is extended or adjusted under 35 U.S.C. 154(b) by 0 days.

This patent is subject to a terminal disclaimer.

(21) Appl. No.: 12/959,828

(22) Filed: Dec. 3, 2010

(65) Prior Publication Data

US 2011/0070033 A1 Mar. 24, 2011

Related U.S. Application Data

(62) Division of application No. 11/808,167, filed on Jun. 7, 2007, now Pat. No. 7,866,922.

(30) Foreign Application Priority Data

Feb. 14, 2007 (IT) ..... PC2007A0010

(51) Int. Cl.
*E02D 7/00* (2006.01)

(52) U.S. Cl. ..... 405/232; 405/231; 405/233; 405/239; 405/244

(58) Field of Classification Search ..... 405/229, 405/231, 232, 233, 236, 237, 240, 241, 244, 405/259.1, 259.5, 269; 175/67, 171
See application file for complete search history.

(56) References Cited

U.S. PATENT DOCUMENTS

| | | | | |
|---|---|---|---|---|
| 3,420,320 | A | 1/1969 | Washita | |
| 3,682,256 | A | 8/1972 | Stuart | |
| 3,742,717 | A | 7/1973 | Wey | |
| 3,844,362 | A | 10/1974 | Elbert et al. | |
| 4,199,011 | A | 4/1980 | Kreft et al. | |
| 4,938,193 | A | 7/1990 | Raufeisen et al. | |
| 5,304,016 | A * | 4/1994 | Kunito | 405/233 |
| 5,575,593 | A | 11/1996 | Raaf | |
| 5,868,523 | A | 2/1999 | Niclell et al. | |
| 5,901,798 | A | 5/1999 | Herrera et al. | |
| 5,919,005 | A | 7/1999 | Rupiper | |
| 6,120,214 | A | 9/2000 | Iovino | |
| 7,866,922 | B2 * | 1/2011 | Melegari | 405/232 |

FOREIGN PATENT DOCUMENTS

EP 1 719 841 11/2006

* cited by examiner

*Primary Examiner* — David Bagnell
*Assistant Examiner* — Benjamin Fiorello
(74) *Attorney, Agent, or Firm* — Young & Thompson

(57) ABSTRACT

An equipment for constructing micropiles in soil, includes a drilling rod with a bit with at least one nozzle jetting fluid forward, and at least one nozzle jetting fluid substantially orthogonal; an element pulling a protective tube, not adhering to the rod. A corresponding method includes drilling with a drilling rod jetting liquid in front of the bit until reaching stable soil strata; drilling and injecting high-pressure grout with one or more lateral nozzles, while the drilling rod rotates; pulling the protective tube, the tube being inserted to the area of grout injection; when the required depth is reached, the proximal end of the drilling rod is anchored to a plate; when the grout is consolidated, traction is applied to the drilling rod if necessary. Grout is injected into the protective tube.

3 Claims, 3 Drawing Sheets

EQUIPMENT AND METHOD FOR CONSTRUCTING MICROPILES IN SOIL, IN PARTICULAR FOR THE ANCHORAGE OF ACTIVE ANCHORS

CROSS-REFERENCE TO RELATED APPLICATION

This application is a divisional of co-pending U.S. application Ser. No. 11/808,167, filed on Jun. 7, 2007, and applicant herewith claims the benefit of priority of Italian application No. PC2007A000010, filed on Feb. 14, 2007. The entire contents of each of the above-identified applications are hereby incorporated by reference.

STATEMENT REGARDING FEDERALLY SPONSORED RESEARCH OR DEVELOPMENT

None.

THE NAMES OF THE PARTIES TO A JOINT RESEARCH AGREEMENT.

None.

INCORPORATION-BY-REFERENCE OF MATERIAL SUBMITTED ON A COMPACT DISC

None

BACKGROUND OF THE INVENTION

1. Field of the Invention

This invention relates to equipment and the corresponding method for constructing concrete micropiles of the type used for soil consolidation, underpinning and the like, or for the anchorage of tie-rods, especially active anchors.

The equipment according to the invention includes a disposable drilling rod fitted at the tip with a bit equipped with two or more nozzles for the injection of a liquid at high pressure; and means designed to pull a tubular protective element, not adhering to the drilling rod, together with said rod during drilling.

In detail, the invention involves fitting to the drilling rod a conical sleeve with one threaded end for connection to the tubular protective element, which said conical sleeve is fitted to the rod in such a way that it can rotate, stop means which prevent it from traversing being fitted, so that the drilling rod can rotate freely and pull said sleeve into the ground during drilling.

The invention also relates to a method of constructing micropiles which involves drilling with a disposable drilling rod that pulls a protective tube, which does not adhere to the drilling rod, with said rod during drilling; when the area of stable soil is reached, drilling continues, and a mixture of water and cement is simultaneously injected into the soil while the drilling rod descends and rotates; after drilling, the proximal end of the drilling rod is anchored to a plate and traction is applied if necessary.

The method according to the invention not only enables micropiles to be constructed in a short time, with a considerable saving on the cost of the finished product, but also allows the construction of active anchors, namely tie-rods to which traction can be applied after they have been laid.

One of the most effective methods of stabilising soil or slopes, or increasing the load-bearing capacity of soil, is the construction of micropiles, a technique that involves making reinforced concrete piles of suitable size in the soil in order to stabilise the soil and increase its ability to bear loads.

In accordance with known techniques, these piles are constructed by drilling a hole in the ground with a drilling rod fitted with a bit at the tip, inserting steel reinforcement in the hole, and filling it with concrete.

This is a rather laborious technique, which involves long working times and correspondingly high costs.

2. Description of Related Art

In recent years a new technique has been developed, described in European patent application no. 1,719,841 by the same applicant, which involves drilling with a rod that acts as reinforcement for the pile and injecting grout directly during drilling; this means injecting downwards from the surface, unlike the earlier methods, in which the grouting stage was performed upwards, from the bottom of the hole to the surface.

BRIEF SUMMARY OF THE INVENTION

The present invention, which falls into this sector, relates to equipment and the corresponding method for constructing micropiles, in particular for the anchorage of active anchors, which further improves said prior art.

In particular, the method and equipment according to the invention allow the micropile to be constructed at a given depth, so that only the areas of stable ground, situated at a certain depth, bear the load.

For this purpose, the invention involves the use of drilling equipment consisting of a drilling rod fitted with a bit at the tip and nozzles for the injection of high-pressure grout into the soil, said rod being fitted with means designed to pull a protective tubular sheath into the soil during excavations.

Said system allows the drilling rod to be inserted to the required depth, followed by grout injection to construct the pile in stable soil; when the grout has been consolidated, the drilling rod is anchored on the surface and traction is applied with techniques similar to pre-stressing techniques.

The presence of the tubular sheath not only allows traction to be applied to the rod that constitutes the reinforcement, but also effectively protects it against corrosion.

BRIEF DESCRIPTION OF THE SEVERAL VIEWS OF THE DRAWINGS

This invention will now be described in detail, by way of example but not of limitation, by reference to the annexed figures wherein.

is DETAILED DESCRIPTION OF THE INVENTION

Figure 1:
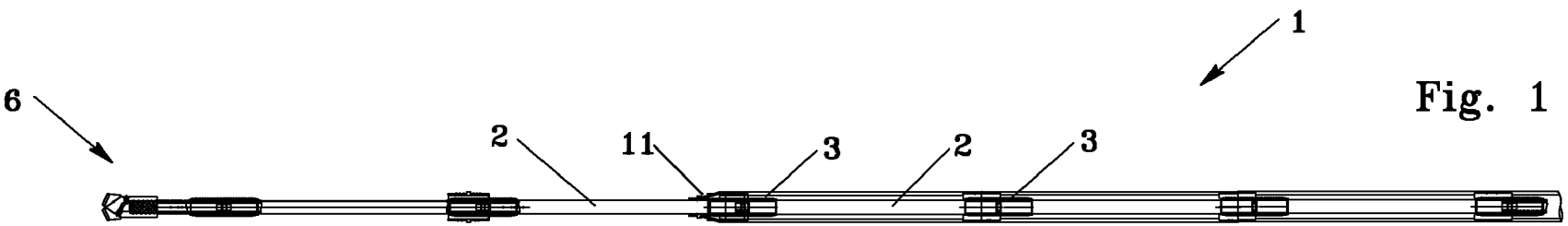
FIG. 1 illustrates a drilling rod according to the invention, in cross-section.
Figure 2:
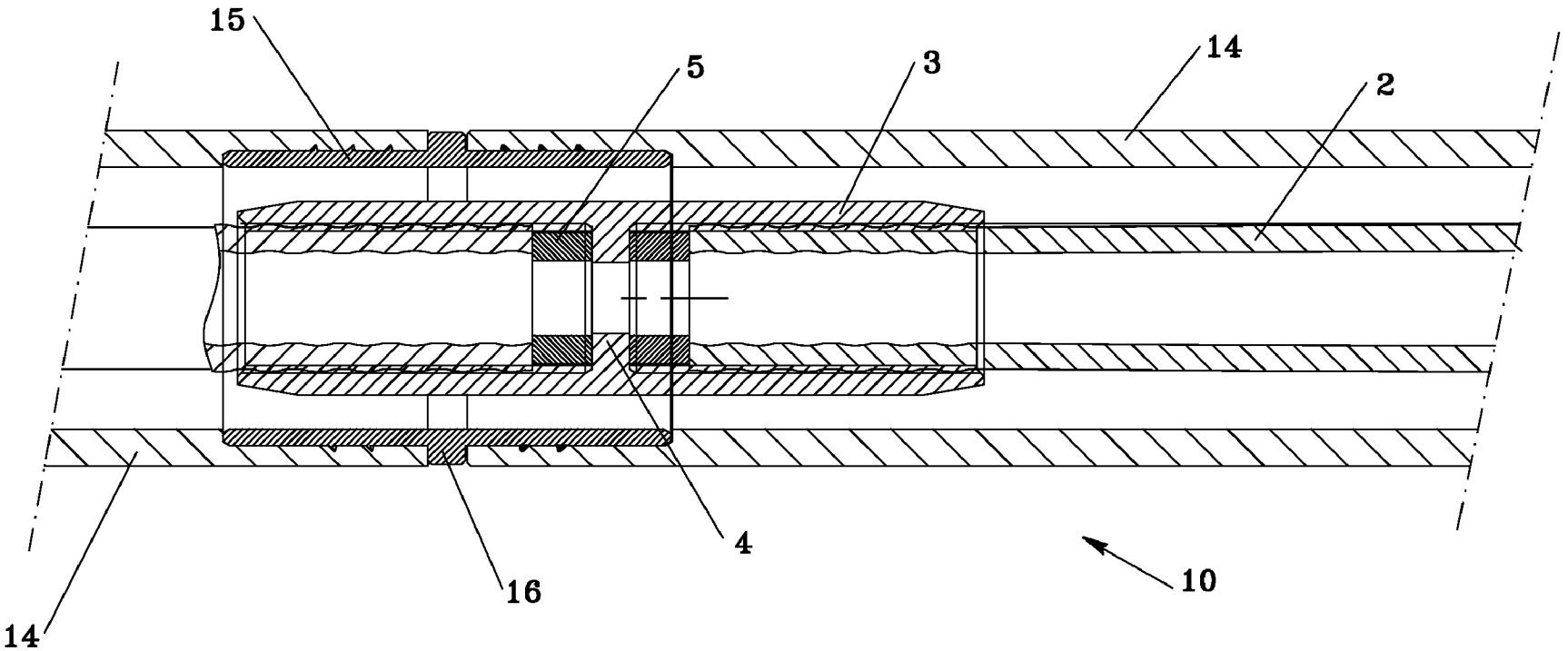
FIGS. 2 and 3 illustrate two details of the drilling rod shown in FIG. 1, again in cross-section.

In FIG. 1, no. 1 indicates a drilling rod assembly according to the invention, consisting of a series of steel bars 2, of known type, which are connected end to end via threaded sleeve couplings 3, which present an abutment 4 in the centre against which the head ends of the bars rest, with the interposition of a seal 5.

In accordance with an advantageous characteristic of the invention, said seals are made of metal, in particular aluminium.

Drilling rod 1 is hollow and fitted at the head with a bit 6 that presents two or more nozzles 7 and 8, which communicate with axial tube 9 present inside the drilling rod, which in turn communicates with systems designed to convey a high-pressure fluid along the drilling rod.

One or more of nozzles (7) directs a jet of water into the area in front of the bit, to disintegrate the soil and aid penetration, while the other nozzles (8) are directed perpendicular to the rod and inject a mixture of water and cement at high pressure to form a concrete column or pile in the soil as the rod advances, rotating.

The rod is preferably galvanised, to provide greater protection against corrosion over time.

A characteristic feature of the invention is that it includes means designed to pull a protective tube 10 made of plastic, such as polyethylene, into the ground as the drilling rod advances.

Said means consist of a cone-frustum-shaped sleeve 11 which is fitted over the rod, the end of said sleeve with the larger diameter being threaded for connection, either directly or via a threaded tubular connector 12, to tubular sheath 10.

Figure 3:
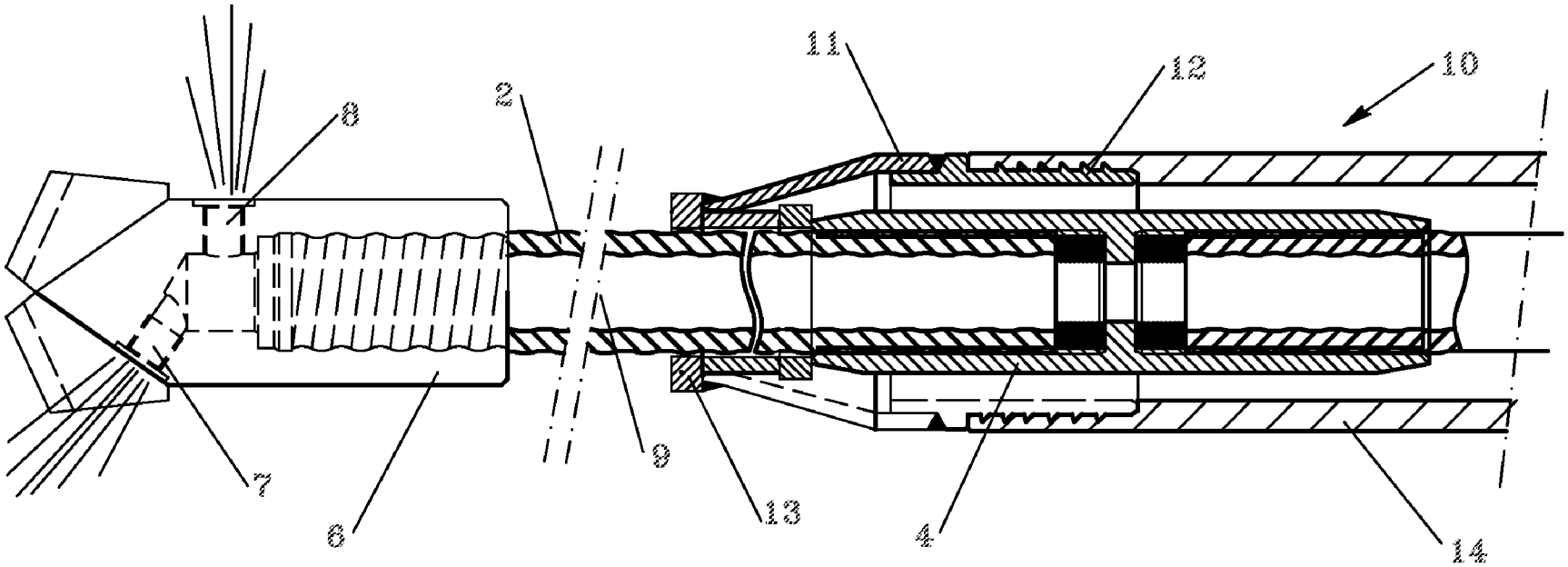

The front end of sleeve 11, shown as no. 13 in FIG. 3, is mounted loose on the drilling rod, so that it can rotate freely in relation thereto.

However, traverses of sleeve 11 along the drilling rod axis are prevented by stop means, which can be formed directly by one of connectors 4 that join the various drilling rod sections, or by a ring screwed onto said rod.

In this way the drilling rod can rotate freely in relation to the tubular sheath, which is pulled into the ground by the advancing rod.

Protective sheath 10 also consists of various sections shown as 14, joined by threaded metal sleeves 15 which always have an annular abutment 16 in the central area that acts as stop means.

Tubular plastic sheath 10, together with the galvanising treatment of the drilling rod, guarantees effective protection against corrosion, and the equipment described complies with the specifications imposed by the legislation for anchors classed as permanent.

Figure 4:
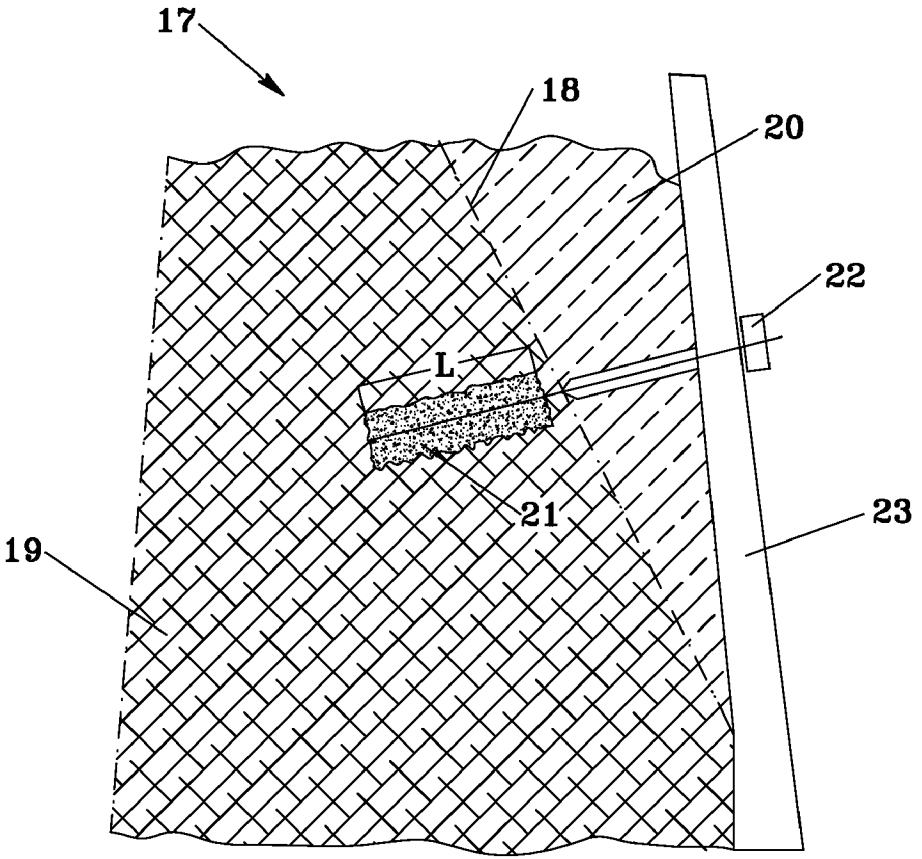
FIG. 4 schematically illustrates a possible application of the equipment and method according to the invention.

FIG. 4 schematically illustrates the method of constructing the active anchors according to the invention.

In this figure, no. 17 indicates a block of soil to be stabilised and 18 identifies the angle of friction that separates zone 19 of stable, compact soil from a zone 20, consisting of loose soil.

The method according to the invention involves the use of the equipment described above, wherein sleeve 11 is positioned at a distance from the bit which is substantially equal to length "L" of the piles to be constructed in the soil.

The method requires drilling to begin with the injection, through nozzles 7, only of the amount of water required to disintegrate the soil and facilitate the advance of the bit.

When the bit goes beyond line 18 and starts to drill in the area of compact soil, injection of high-pressure grout also begins, so as to form a concrete pile 21 that surrounds the drilling rod in the layer of compact soil.

When the required depth is reached, the situation will be as illustrated in FIG. 4, with a cement pile anchored in the solid ground, and the drilling rod protected by grout in this first section and by tubular sheath 10 in the section upstream of sleeve 11, which extends through the whole area of loose soil.

The proximal end of the rod can be anchored to a plate 22, which in turn is fixed to a load-spreading beam or the like 23.

When the cement has been consolidated, traction can be applied to the drilling rod with the usual pre-stressing techniques, and the pile is completed by injecting grout into tubular sheath 10, to provide greater protection over time.

What is claimed is:

1. A method for the construction of active anchors in soil, said method comprises the following stages:

drilling with a rotating drilling rod fitted at the head with a bit comprising at least one nozzle adapted to inject a high-pressure liquid in front of the bit until the stable soil strata are reached, said drilling rod being comprised of a number of elements and, while rotating, driving the rotation of said bit;

injecting a high-pressure grout, when the rotating bit reaches and begins to drill the stable soil strata and while it continues to drill such stable soil strata, so as to form a concrete pile that surrounds the drilling rod in the stable soil strata, wherein said high-pressure grout is injected through one or more lateral nozzles provided on said bit;

pulling a protective tube that does not adhere to the drilling rod during said drilling, said protective tube being inserted as far as the area where the rotating bit reaches the stable soil strata and thereby the grout injection begins;

anchoring the proximal end of the drilling rod to a plate, when the required depth has been reached;

applying a traction to the drilling rod if necessary, when the grout has been consolidated; and finally injecting grout into said protective tube.

2. The method as claimed in claim 1, wherein the drilling rod is left in the ground to act as reinforcement for forming a pile.

3. Equipment for constructing micropiles in soil, including:

a hollow drilling rod fitted with a bit positioned at the tip of said drilling rod, said drilling rod being comprised of a number of elements and being adapted, by rotating, to drive the rotation of said bit, said bit comprising at least one nozzle adapted to direct a jet of fluid in front of the bit, and at least one nozzle adapted to direct a jet of fluid in a direction substantially orthogonal to the axis of the drilling rod;

an axial tube positioned inside the drilling rod, said axial tube being in communication with said nozzles and adapted to convey a fluid along the axial tube to said nozzles during rotation of said drilling rod; and a sleeve that is positioned over the drilling rod and configured to pull a protective tube into the ground as the drilling rod advances, said sleeve being mounted loose on said drilling rod so that the drilling rod can rotate freely in relation to said sleeve and said protective tube, wherein said axial tube is configured to convey high-pressure fluid along the drilling rod to said nozzles, during rotation of said drilling rod, and the jet of fluid directed in front of the bit aids penetration of the drilling rod by disintegrating soil in the ground to be drilled, and wherein the jet of fluid directed substantially orthogonal to the axis of the drilling rod comprises a mixture of water and cement to form a concrete column or pile in the soil as the drilling rod advances.

* * * * *